US005192179A

United States Patent [19]

Kovacs

[11] Patent Number: 5,192,179

[45] Date of Patent: Mar. 9, 1993

[54] LIFT ARM AND TILT LINKAGE SYSTEMS FOR LOAD ELEVATING VEHICLES

[76] Inventor: Geza Kovacs, 1102 Sugartree Dr. S., Lakeland, Fla. 33813

[21] Appl. No.: 705,581

[22] Filed: May 24, 1991

[51] Int. Cl.[5] ..... E02F 3/34

[52] U.S. Cl. ..... 414/710; 414/917

[58] Field of Search ..... 414/706, 707, 710–713, 414/917, 700

[56] References Cited

U.S. PATENT DOCUMENTS

| | | | |
|---|---|---|---|
| 2,449,212 | 9/1948 | Fraga | 414/917 |
| 2,455,474 | 12/1948 | Drott et al. | 414/707 |
| 2,628,730 | 2/1953 | Speicher et al. | 414/711 X |
| 2,665,017 | 1/1954 | McNamara, Jr. | 414/707 |
| 2,712,389 | 7/1955 | Sewell et al. | 414/707 X |
| 2,720,990 | 10/1955 | Beyerstedt | 414/707 |
| 3,175,711 | 3/1965 | Granryd | 414/707 |
| 3,215,292 | 11/1965 | Halls | 414/707 |
| 3,237,795 | 3/1966 | Kromer | 414/723 |
| 3,703,968 | 11/1972 | Ulrich et al. | 414/917 |
| 3,722,724 | 3/1973 | Blakely . | |
| 3,767,075 | 10/1973 | Leverenz | 414/917 |
| 3,792,786 | 2/1974 | Goikhburg et al. | 414/710 |
| 3,888,371 | 6/1975 | Moreau | 414/712 X |
| 3,952,896 | 4/1976 | Hayward | 414/700 |
| 3,995,746 | 12/1976 | Usagida | 414/917 |
| 4,264,264 | 4/1981 | McMillan et al. | 414/686 |
| 4,355,946 | 10/1982 | Wykhuis et al. | 414/707 |
| 4,583,907 | 4/1986 | Wimberley | 414/718 |
| 4,699,560 | 10/1987 | Ostermeyer et al. | 414/696 |
| 4,825,568 | 5/1989 | Kawamura et al. | 414/722 |
| 4,844,685 | 7/1989 | Sagaser | 414/699 |
| 4,923,362 | 5/1990 | Fryk | 414/700 |

FOREIGN PATENT DOCUMENTS

| | | | |
|---|---|---|---|
| 401738 | 4/1967 | Australia | 414/707 |
| 2822050 | 11/1979 | Fed. Rep. of Germany | 414/700 |
| 247643 | 7/1987 | German Democratic Rep. | 414/917 |
| 866619 | 4/1961 | United Kingdom | 414/707 |

*Primary Examiner*—Michael S. Huppert
*Assistant Examiner*—William M. Hienz
*Attorney, Agent, or Firm*—Dowell & Dowell

[57] ABSTRACT

Tilt linkage and lift arm systems by way of which implements including buckets, backhoes, grapples and forks and the like are mounted with respect to conventional load lifting vehicles including tractors, loaders, forklifts, bulldozers and the like wherein the tilt linkage members form at least two parallelograms having a common link through the lift arm(s) whereby the systems continuously and automatically level the implement as it is raised or lowered unless the tilt linkage is activated to change the pitch of the implement relative to the vehicle. In some embodiments more than one set of two or more parallel tilt linkages may be connected in end to end relationship between the vehicle and the implement.

20 Claims, 6 Drawing Sheets

FIG. 4C
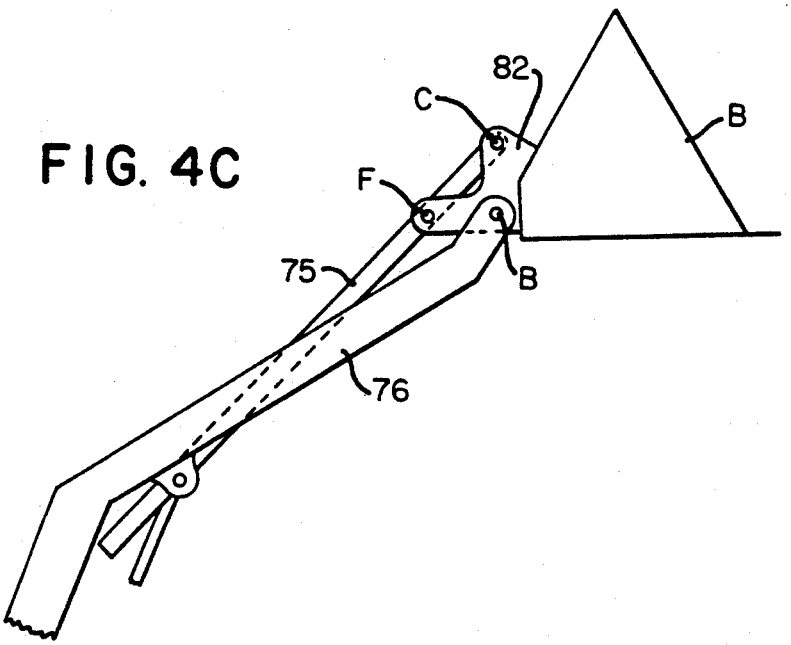
FIG. 4B
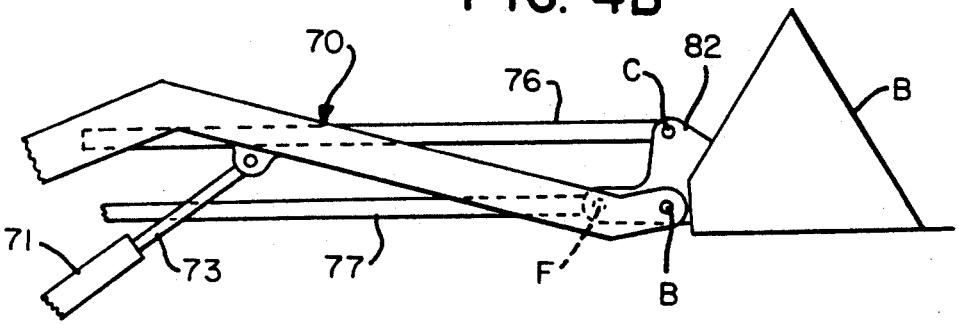
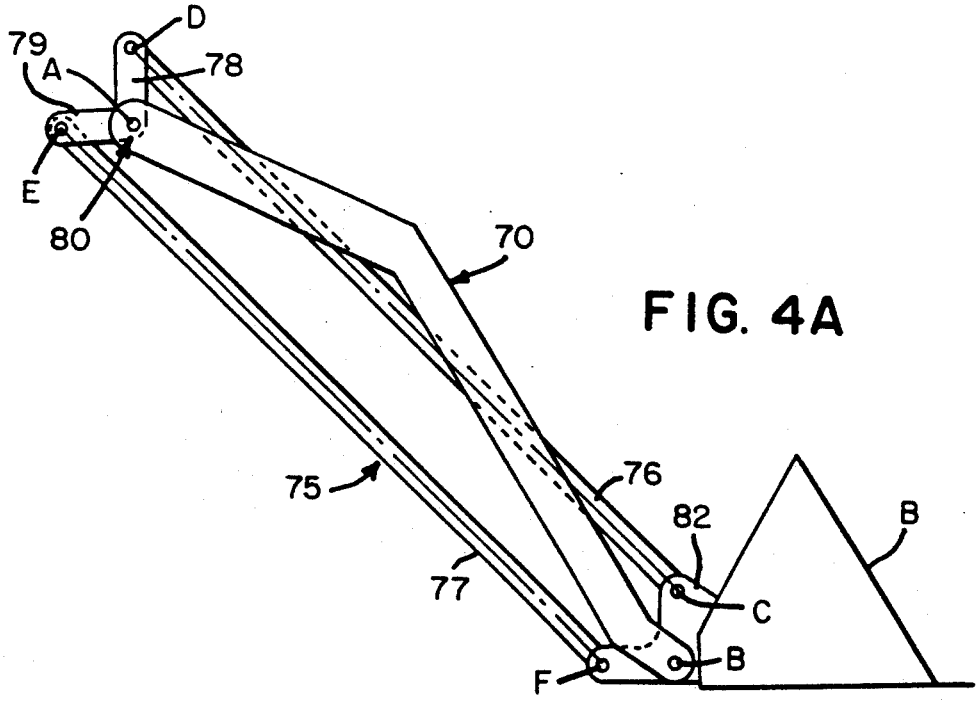
FIG. 4A

LIFT ARM AND TILT LINKAGE SYSTEMS FOR LOAD ELEVATING VEHICLES

BACKGROUND OF THE INVENTION

1. Field of the Invention

This invention is generally directed to the lift arm(s) and tilt linkage mechanisms by way of which implements are raised, lowered and angularly adjusted relative to load lifting vehicles such as front-end loaders, backhoes, skid-steered tractors, forklifts and the like and more specifically to a multiple parallelogram tilt linkage system which in cooperation with the lift arm or arms of the vehicle automatically ensures that the pitch of the implement is not altered as the lift arms raise and lower the implement unless the controls for adjusting the pitch of the implement are activated. The invention is also directed to lift arm and tilt linkage systems for load elevating vehicles wherein the lift and tilt cylinders for both lifting the implement and adjusting the pitch of the implement relative to the vehicle are mounted remote with respect to the implement and are preferably directly mounted to the vehicle to thereby eliminate the need to extend hydraulic lines outwardly with respect to the vehicle where such lines would be subject to wear and tear, dirt and accidental damage.

2. History of the Related Art

One of the primary problems associated with construction and load lifting and transporting vehicles such as forklifts, bulldozers, front-end loaders, skid-steered tractors, backhoes, and the like are that the implements associated therewith are continuously subject to change in pitch relative to the vehicle as the implements are raised and lowered by the lift arm(s) of the vehicle. Due to the change in the pitch of an implement the loads supported thereby are not maintained absolutely level as they are raised and lowered. In those instances where the implement is a bucket having aggregate material contained therein, if the bucket changes from a level position the material is accidentally discharged over the edge of the bucket. Similar problems occur when transporting pallets on which materials are stacked or when transporting and aligning loads of sensitive materials such as in the lifting of munitions from ammunition carrying carts to aircraft to which the munitions are to be mounted.

In view of the foregoing problem there have been numerous attempts to provide lift arm and tilt linkage mechanisms which will compensate for the change in pitch of an implement as the implement is raised or lowered. Unfortunately, such conventional systems do not provide a true self levelling system which will ensure a continuous fixed pitch alignment between the implement and the vehicle regardless of the degree of elevation of the implement with respect to the vehicle as the implement is raised or lowered by the vehicles lift arm assembly.

In U.S. Pat. No. 4,355,946 to Wyckhuis et al. a lift arm and control linkage assembly for loading buckets is disclosed for maintaining the buckets in substantially level positions during lifting. However, as the patent indicates, the position of the bucket is only substantially maintained in a fixed pitch or position and actually the pitch changes as the bucket is raised or lowered relative to the vehicle. The system utilizes counter-clockwise pivotable linkages which are connected through a bell crank assembly to lift arms and tilt cylinders which are mounted between the bucket and the bell crank arrangement. Such a system requires that the hydraulic cylinder which controls the tilt of the bucket to be mounted to the bucket or bucket support and the bell crank mechanism at a location remote from the vehicle itself. This requires that hydraulic lines must be extended from the vehicle outwardly to the tilt cylinder(s). Such an arrangement has a disadvantage of requiring the exposure of the hydraulic cylinder outwardly of the vehicle at which point it is subject to wear and tear, dirt and other debris and also requires that hydraulic lines be extended through the lift arms thereby exposing the hydraulic lines to possible accidental damage. Therefore, not only does this linkage mechanism not provide a continuously self-levelling effect but also exposes the tilt cylinders and hydraulic lines to additional wear and tear. Similar type lift and tilt assemblies are disclosed in U.S. Pat. No. 3,237,795 to Kromer, U.S. Pat. No. 3,722,724 to Blakely, U.S. Pat No. 4,825,568 to Kawamura et al. and U.S. Pat. No. 4,264,264 to McMillan et al.

In an effort to improve the self-levelling of lift and tilt control mechanisms for vehicles having lift implements such as buckets, complicated control systems were developed to automatically adjust the hydraulics electronically in order to continuously adjust the bucket to maintain a substantially constant pitch of the bucket with respect to the vehicle as the implement raised and lowered. One such example of an electronic bucket positioning and control system is disclosed in U.S. Pat. No. 4,844,685 to Sagaser. Such systems however do not maintain a bucket in a constant or fixed pitch a minute adjustments are continuously made to the tilt cylinder linkage in order to adjust the bucket relative to the lift assembly to maintain a substantially constant pitch as the lift arms of the vehicle are raised and lowered. Such systems are also very costly in that they require the electronic features to be connected to the hydraulic control circuits to maintain the required amount of levelling. A further variation of the prior art is disclosed in U.S. Pat. No. 4,923,362 to Fryk which discloses the use a hydraulic valve system connected to an electronic control circuit for adjusting the hydraulic controls of the lift and tilt arms to maintain a bucket in a level configuration. Such a system also is expensive, complicated and does not provide a truly continuous self-levelling of an implement carried by the vehicle.

Other types of self-levelling systems have been proposed which are generally mechanical in nature. The most predominant of these appear to be referred to as "parallelogram" linkages or linkage system. An example of such a system is disclosed in British Patent 866,619 of Apr. 26, 1961. This patent discloses the use of a pair of link members which extend generally parallel to the lift arms of the implement support frame and which are pivotably connected with respect to one another by an intermediate triangular frame member with the pivots of the frame member being generally parallel to the vehicle and the pivot points on the implement support frame. In this manner, two end to end parallelograms are formed by the links and the lift arms of the vehicle. Such an arrangement does provide for a limited vertical lifting of the implement without changing pitch of the implement support frame. However with this type of arrangement, the tilt cylinder is mounted on the implement support frame and therefore any adjustment with respect to the implement must be accomplished utilizing the hydraulic cylinder which is mounted exteriorly of the vehicle on the implement support frame thereby necessitating that hydraulic lines are extended along the length of the lift arms and implement support extension members. Additional examples of parallel linkage systems are disclosed in German Offenlegungsschraft 28 22 050 of Nov. 22, 1979, German Patentscrift DD 247 643 A of Jul. 15, 1987, Soviet Union Patents 1073-087-A of Feb. 15, 1984 and 1161-372-A of Jun. 15, 1985, and U.S. Pat. No. 2,665,017 to McNamara, Jr., U.S. Pat. No. 3,703,968 to Uhrich et al., U.S. Pat No. 3,792,786 to Gokhburg et al. and U.S. Pat No. 4,583,907 to Wimberley.

Additional examples of hydraulic linkage mechanisms for supporting implements and controlling their pitch relative to lift vehicles are disclosed in U.S. Pat. No. 2,455,474 to Drott et al., U.S. Pat. No. 2,720,990 to Beyerstedt et al., U.S. Pat No. 3,175,711 to Granryd, U.S. Pat. No. 3,215,292 to Halls, U.S. Pat. No. 3,952,896 to Hayward and U.S. Pat. No. 4,699,560 to Ostermeyer.

SUMMARY OF THE INVENTION

This invention is directed to lift arm and tilt linkage systems for use with load carrying vehicles including front-end loaders, bulldozers, backhoes, forklifts, tractors and the like wherein the vehicles include implements such as buckets, scoops, forks, or other load carrying devices wherein the implementation are automatically and continuously maintained in a fixed pitch or level position with respect to the vehicle as the implements are raised and lowered by the vehicle lift arm or arms. With the invention the lift arm or arms are connected to a vehicle so as to be moveable about a first pivot axis and are connected to the implement so as to be moveable about a second pivot axis which axis are parallel with respect to one another. The tilt linkage includes a pivotable knuckle which is mounted about a fixed axis which is aligned with the first pivot axis of the lift arm. The knuckle includes at least two outwardly extending arms which are generally offset at an angle of less than 120° with respect to one another and include pivot connections which are spaced from the pivot axis of the knuckle. A pair of elongated links have first ends which are pivotably mounted to the pivot connections of the outer ends of the arms and remote ends which are pivotably mounted to the implement or to an implement support frame. A first of the links is mounted above the second pivot axis but parallel thereto and the other link is mounted below but parallel to the second pivot axis. In this manner each of the links together with the lift arm or arms form a pair of imaginary parallelograms each having a common side, which cooperate to maintain the pitch of the implement relative to the vehicle. In one embodiment the knuckle includes a third arm which extends outwardly therefrom and to which is connected one end of a hydraulic or pneumatic cylinder extension rod which when actuated urges the third arm to pivot the knuckle relative to its support axis.

With the tilt linkage system of the present invention, if the tilt cylinder connected to the knuckle is not activated as the lift arms are raised and lowered the tilt linkage mechanism automatically shifts or re-aligns by a relative partial rotation of the links relative to the first and second pivot axis to thereby continuously maintain the pitch or alignment of the implement in a fixed orientation regardless of the elevation of the implement with respect to the vehicle. In some embodiments separate pairs of lift arm and two or more parallelogram tilt linkages may be connected in end to end relationship between the vehicle and the implement or the implement mounting frame so that different angular lift capabilities are provided for such as in the case of a backhoe implement.

The invention also ensures that the operating mechanisms, which in the preferred embodiments are hydraulic cylinders for adjusting both the lift arms and the tilt linkage system, are mounted to or immediately adjacent to the vehicle body or frame and preferably recessed within the body so that all hydraulic lines are retained within the body of the vehicle and are therefore not subject to accidental damage and wherein the hydraulic cylinders themselves are also protected from dirt and debris which they would otherwise be subjected to if mounted adjacent to the implement or along the boom assembly comprising the lift arm and linkage mechanism.

It is a primary object of the present invention to provide a continuously self levelling tilt linkage system for use in mounting implements to load lifting and carrying vehicles which linkage system continuously maintains a predetermined pitch of the implement relative to the vehicle as the implement is raised or lowered with respect to the vehicle and with the pitch of the implement only being altered upon the direct activation of controls mounted to the tilt linkage system.

It is also an object of the present invention to provide a linkage mechanism for regulating the tilt of an implement relative to vehicles such as a front-end loaders, bulldozers, skid-steered tractors, backhoes, forklifts and the like wherein a simple mechanical multiple parallelogram assembly which includes the linkage mechanism and the lift arms of the vehicle provides a low cost yet durable mechanical mechanism for ensuring a continuous self levelling of the implement during its vertical repositioning by the raising and lowering of the vehicle lift arms.

It is yet another object of the present invention to provide a tilt linkage assembly and lift arm assembly for use with load lifting vehicles wherein the hydraulic or pneumatic controls for activating the linkage and lift arm members are maintained remote from the implement and are preferably housed within or adjacent to the body of the vehicles to thereby prevent the exposure of hydraulic and pneumatic lines exteriorly of the vehicles.

It is a further object of the present invention to provide a tilt linkage system and vehicle lift arm assembly for use with load lifting vehicles wherein sets of the linkages and lift arm members may be connected in end to end relationship to thereby allow greater flexibility in positioning of an implement relative to the vehicle and wherein the level or pitch of the implement is continuously maintained unless selectively adjusted is made by activation of the controls for the tilt linkage mechanism by the operator of the vehicle.

BRIEF DESCRIPTION OF THE DRAWINGS

FIGS. 4A–4C are side elevational view of another embodiment of linkage assembly showing an implement in lowered, intermediate and raised positions, respectively.

DESCRIPTION OF THE PREFERRED EMBODIMENT

Figure 1A:
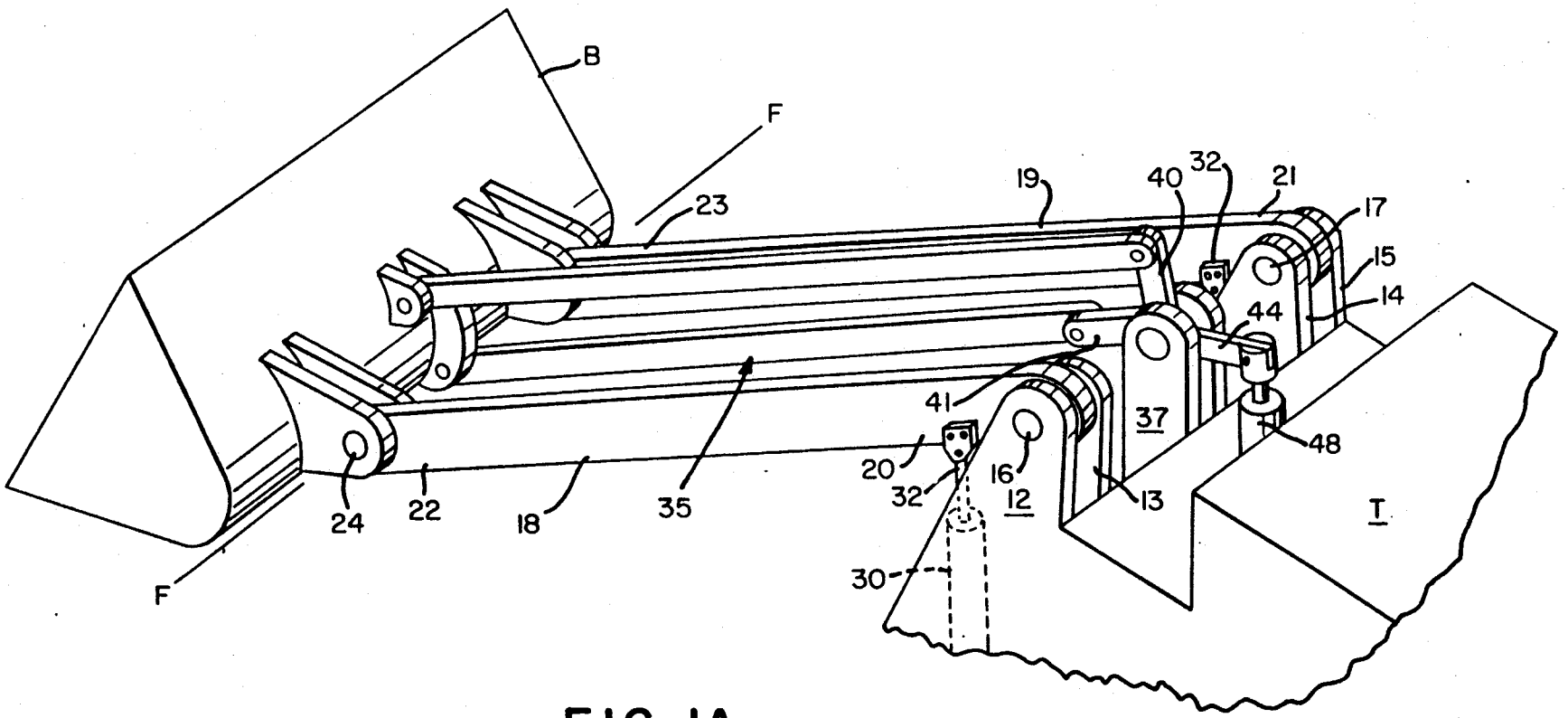
FIG. 1A is a partial perspective view of an embodiment of implement lift and tilt control linkage assemblies of the present invention showing the implement in a lowered position.

With reference to the drawings figures a number of embodiments of the invention will de disclosed in greater detail. In the embodiments shown in FIGS. 1A–1C a first embodiment is disclosed wherein the linkage and lift arm assemblies of the present invention are shown as being mounted to the front end of a loader or skid-steered tractor T. In the drawing figures the implement shown is a conventional earth working bucket B having a generally convex rear surface and a front lower leading edge. Although the implement shown is a bucket, it should be emphasized that the invention may be utilized to mount any type of implement including forks, grab hooks, load lifting platforms and the like. In addition, in some instances it may be desirable to utilize a mounting frame to which different implements may be attached and wherein the connections discussed with respect to this embodiment would be provided on the back of the implement mounting frame.

The tractor T includes two pair of flange elements 12 and 13, 14 and 15 respectively having pivot pins 16 and 17 mounted therebetween so that the pivot pins are aligned along a first pivot axis defined A—A. To lift the bucket B vertically with respect to the tractor T a pair of lift arms 18 and 19 have their uppermost ends 20 and 21, respectively, pivotably mounted to the pivot pins 16 and 17. The lower ends 22 and 23, respectively, of lift arms 18 and 19 are shown as being pivotably mounted by connecting bolts 24 and 25 to spaced flange elements 26 and 27, 28 and 29 which extend from the rear of the bucket B. The bolts 24 and 25 are aligned on a second pivot axis B—B. To raise the bucket lift arms 18 and 19 a pair of hydraulic cylinders 30 are mounted to the vehicle below each lift arm with the upper portion of the extension rods 32 engaging the lift arms adjacent their upper ends. Appropriate controls are provided for supplying hydraulic fluid to the cylinders so as to extend the extension rods 32 to elevate the lift arms and likewise to retract the rods in order to lower the lift arms. Further, appropriate valving is provided to ensure that the cylinders 30 are actuated in unison with respect to one another so that the bucket B is balanced as it is raised and lowered.

As the bucket B is pivotably mounted to the lower ends of the lift arms it is necessary to stabilize the pitch of the bucket relative to the lift arms as it is raised and lowered. With the present invention a tilt linkage assembly 35 is provided for ensuring not only stabilization of the bucket during raising and lowering but also to control the pitch of the bucket relative to the pivot axis B—B. Further, the tilt linkage assembly of the present invention will continuously assure that once a pitch has been established between the bucket and its pivot axis that such pitch will be maintained regardless of the elevation of the bucket relative to the tractor T.

The tilt linkage assembly of the present invention includes a pivotable knuckle 36 which is mounted between a pair of spaced flanges 37 and 38 by way of a mounting bolt or pivot pin 39. It should be noted that the pin 39 is aligned with the pivot axis A—A of the upper end of the lift arms for reasons which will be discussed in greater detail hereinafter. The knuckle 36 include a pair of spaced arms 40 and 41 which are shown in the drawings as being extended outwardly with respect to one another at approximately 90° which is an optimum angle for the double parallelogram linkage assembly shown in the drawings. However, the arms may be spaced at an angle relative to one another of up to approximately 120° and still function within the teachings of the present invention. An angle of approximately 120° would be optimum for a linkage assembly utilizing a triple parallelogram configuration (not shown). Each of the arms 40 and 41 include outer end portions 42 and 43 respectively having openings therein which are equally spaced with respect to the pivot axis A—A. The knuckle also includes a third arm 44 which extends rearwardly of the spaced flanges 37 and 38 and which has an outer end 45 to which is mounted the upper end 46 of an extension rod 47 of a hydraulic tilt cylinder 48 which is mounted within the body of the tractor. Upon activation of the extension rod 47 the knuckle is pivoted about the pivot axis A—A thereby rotating the arms 40 and 41 about the pivot axis.

The tilt linkage mechanism also includes a pair of elongated links 50 and 51 having their uppermost ends 52 and 53 connected to the arms 40 and 41 respectively by appropriate mounting means such as bolts 54. It should be noted that the rods are mounted on opposite sides of the arms so that the rods are effectively spaced by the thickness of the arms along their length portion. Further, the connections the links and the arms define secondary pivot axis C—C and D—D.

The lower ends 55 and 56 of the links 50 and 51 are mounted between the pairs of spaced opposing flanges 57 and 58, 58 and 59 which are mounted intermediate the flanges 26 and 27, 28 and 29 extending from the rear of the bucket B. The flange 57 is mounted above the flange 59 and Flange 58 extended vertically therebetween. Aligned openings are provided therein defining additional secondary pivot axis E—E and F—F. It should be noted that the pivot axis E—E and F—F are equally vertically spaced above the pivot axis B—B by way of which the bucket is attached to the lower end of the lift arms. The lower ends 55 and 56 of the links 50 and 51 are connected within the aligned openings by spaced bolts 61 and 62 with the lower ends being spaced from one another at the same distance at which the upper ends of the links are spaced form one another.

The tilt linkage assembly together with the lift arms define a double parallelogram support and tilt mechanism for connecting the bucket to the tractor T wherein each parallelogram shares a common side defined by a line extending between the spaced pivot points or axis of the vehicle lift arms. Further, the angular alignment between secondary axis C—C and D—D with respect to pivot axis A—A is the same as between secondary pivot axis E—E and F—F to pivot axis B—B. It is contemplated that additional tilt members could be used so that triple or greater parallelograms would be defined.

Figure 1B:
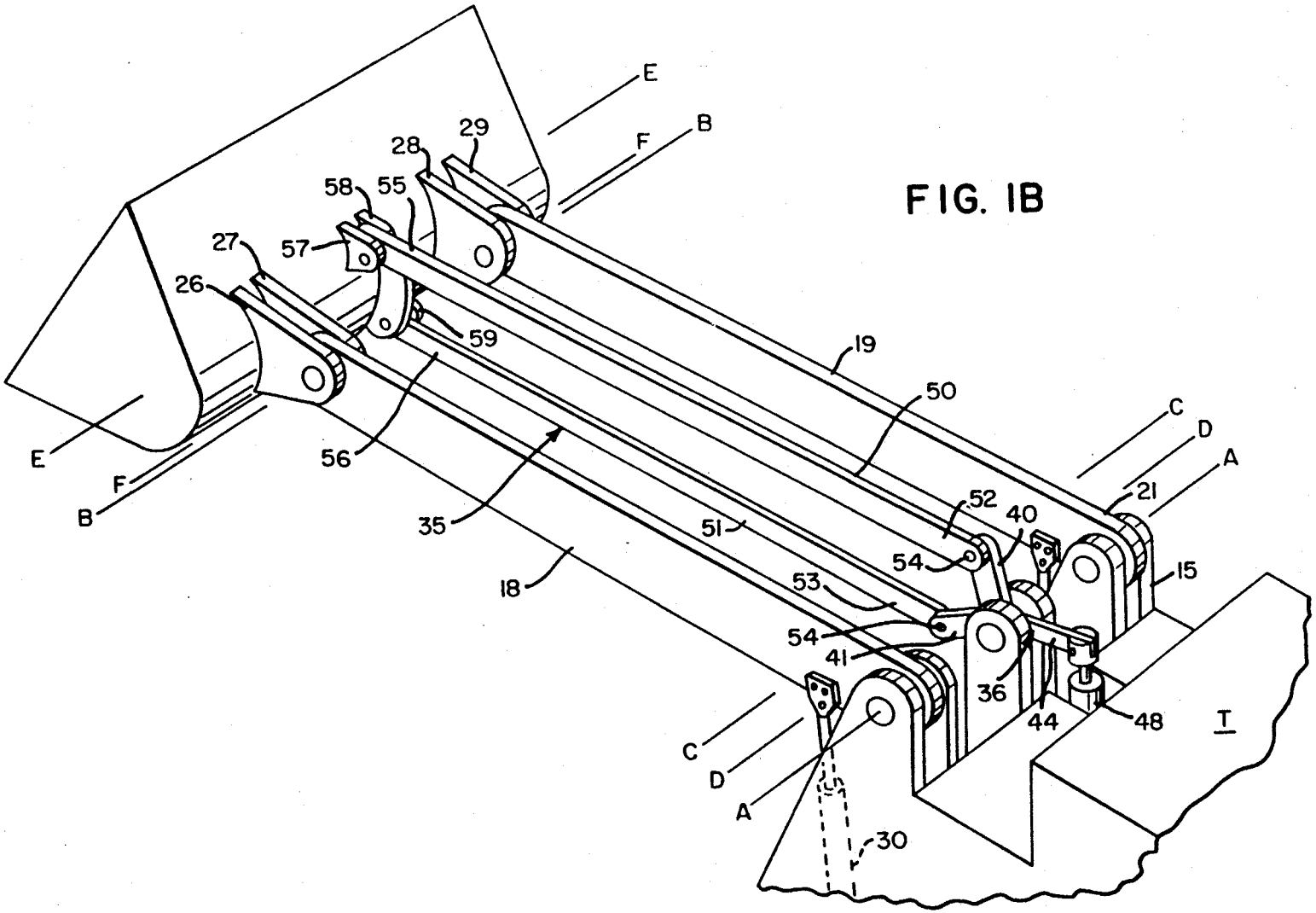
FIGS. 1B and 1C are partial perspective views of the embodiment of FIG. 1 showing the implement lifted to a horizontal and then raised position, respectively.
Figure 1C:
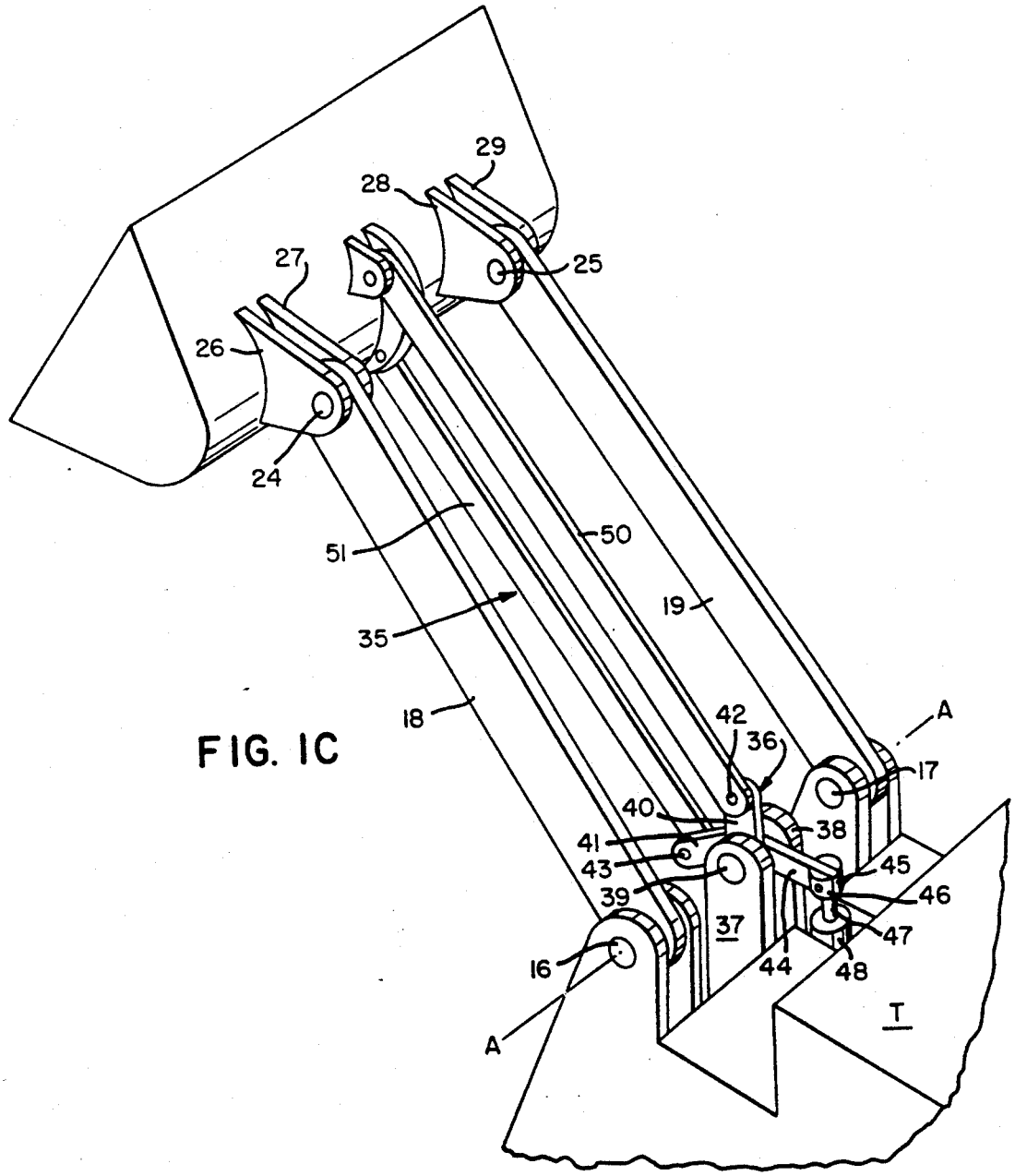

In comparing FIGS. 1A-1C three different elevated positions of the bucket are disclosed. The bucket however is retained in the identical pitch relationship with respect to the axis B—B about which the bucket is pivotably attached to the lift arms. During elevation of the lift arms, the pitch of the bucket is continuously maintained thereby a constant level of the bucket is established regardless of the elevation of the lift arms. The self levelling is accomplished by the relative rotation of the links 50 and 51 relative to the pivot axis A—A and B—B. Only upon activation of the tilt cylinder 48 to either raise or lower the third arm of the knuckle 36 is it possible to change the pitch of the bucket by changing the angular relationship of the connecting points between the upper end of the links and the arms 50 and 51 relative to the pivot axis A—A. When the tilt cylinder is not activated, as the bucket is raised, the alignment of the pivot points along the upper and lower portions of the links 50 and 51 retain their same orientation with respect to one another thereby ensuring the positive pitch alignment of the bucket relative to the tractor T. Further, the links, during periods of the raising and lowering of the lift arms, will in some instances work together to anchor the bucket relative to the lift arms and will at other times act independently with respect to one another to anchor the bucket with respect to the lift arms. Further, the link members are always retained in parallel relationship even though the vertical spacing between them may be altered as the implement is raised or lowered beyond a given degree of rotation with respect to the axis A—A.

In effect the tilt linkage mechanism of the present invention defines an imaginary multiple parallelogram linkage which in the preferred embodiments shown is a double parallelogram system. With respect to the embodiments of FIGS. 1A—1C the double parallelograms are defined along the links 50 from pivot axis E—E to C—C, along arm 40 of knuckle 36 from pivot axis C—C to A—A, along one of the lift arms from pivot axis A—A to B—B and along an imaginary line from pivot axis B—B to pivot axis E—E ($\overline{E\text{-}C}$, $\overline{C\text{-}A}$, $\overline{A\text{-}B}$, $\overline{B\text{-}E}$). On the other hand, the second associated parallelogram extends along link 51 from pivot axis F—F to D—D, along arm 41 of knuckle 36 from pivot axis D—D to A—A, along one of the lift arms from A—A to B—B and along an imaginary line B—B to F—F ($\overline{F\text{-}D}$, $\overline{D\text{-}A}$, $\overline{A\text{-}B}$, $\overline{B\text{-}F}$). The lines of the parallelogram do not actually follow the lift arms but rather extend between the pivot point at the ends thereof.

Due to the double parallel linkage it is possible for the bucket to be raised through any desired angle as the links 50 and 51 will cooperate with respect to one another to support the bucket in a fixed condition. At a point in time when either link 50 or 51 is aligned to intersect the pivot axis A—A and B—B the link becomes non-functional and the opposite link supports the bucket to ensure proper pitch of the bucket in a position.

Figure 2:
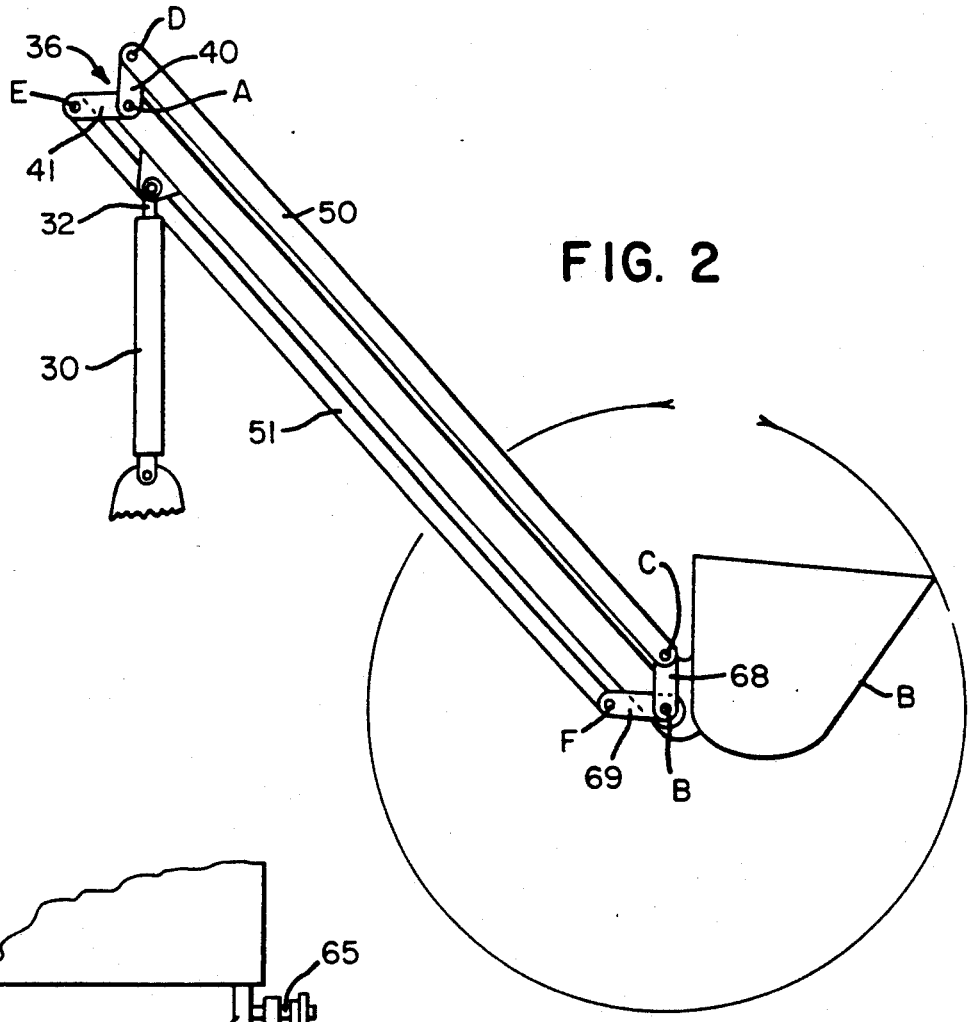
FIG. 2 is a partial side view of another embodiment of implement lift and tilt control linkage assembly of the present invention wherein the implement may be continuously rotated through 360°.
Figure 3:
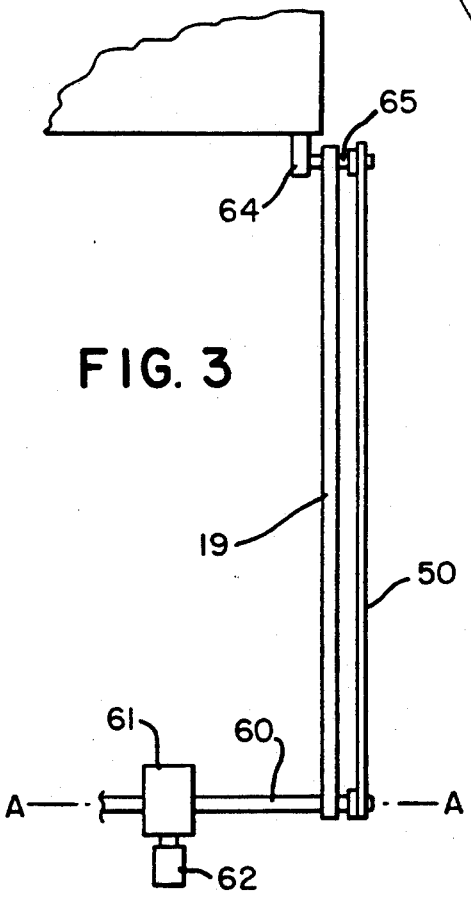
FIG. 3 is a partial top plan view of the linkage assembly of FIG. 2.

The linkage mechanism of the present invention may even be adapted to provide for a complete rotation of the bucket. With respect to FIGS. 2 and 3 a linkage arrangement is disclosed which allows for the complete 360° rotation of the bucket. Such bucket rotation would be desired when handling cable reels. In these instances two sets of tilt linkages may be provided each of which is mounted outside of the lift arms of FIGS. 1A-1C. On the other hand, the links 50 and 51 may be placed on opposite sides of the bucket. The links are mounted to a rotatable shaft 60 which is aligned and forms the pivot axis A—A in this embodiment. Therefore, the upper end of the lift arms will also be mounted about the rod 60. In order to rotate the rod 60 a gear box 61 is mounted in engagement therewith which may include engaging sprockets or teeth which will engage sprockets (not shown) also mounted on the shaft 60. A motor such as the hydraulic motor 62 is provided as a source of power to the gear box. The lift arms are attached to the bucket so as to define a pivot axis B—B as previously discussed however the mounting brackets for the lift arms and linkage system will extend, as shown, at 64 from the rear and adjacent the sides of the bucket. A shaft 65 extends outwardly from each bracket 64 to which the lift arms 18 and 19 are relatively rotatably mounted as well as the links 50 and 51 with link 50 being applied on one side of the bucket and link 51 on the opposite side as shown on FIG. 3. Each of the links 50 and 51 is connected to the rotatable rod 60 by short arms 40 and 41, respectively, fixedly secured on each side of the rod 60 with the arms being oriented in offset angular relationship as set forth above with respect to the embodiment of FIGS. 1A-1C. The lower ends of the links 50 and 51 are likewise mounted to fixed arms 68 and 69 which extend from the shafts 65 extending from the bracket 64. The double parallelogram arrangement is defined, as shown in FIG. 2 between points A, B, C, and D and A, B, F, and E. As the bucket is raised or lowered if the rod 60 is not rotated then the bucket will be retained in a level position and the general angularly relationship between points E, A, D and F, B, C will remain constant during the vertical lift. When it is desired to rotate the bucket the drive motor 62 is engaged thereby driving the rod 60 through the gear box 61 and thereafter the bucket will rotate as indicated in either direction by the arrows in FIG. 2 as the links 50 and 51 rotate about the pivot axis A and B.

With respect to FIGS. 4A-4C another embodiment of the present invention is disclosed. In this embodiment the lift arm and linkage assemblies are shown in the side plan view and in certain instances the lift arms will be aligned so only one side of the assembly will be described. In the embodiment, the lift arms 70 are shown as being sectioned so that they extend outwardly and then downwardly and then outwardly again along their length. Therefore, the configuration of lift arms utilized in accordance with the teachings of the present invention may vary and still be within the teachings of the present invention. In the embodiment of FIGS. 1A-1C the lift arms were shown as being straight with the axis between the pivot points A and B extending along the longitudinal axis of the arms. In the present embodiment the upper and lower pivot points A and B remain the same however the lift arm is disposed outside of the axis. Further, the lift cylinders 71 are provided on either side of the vehicle and are attached through yokes 72 midway along the length of the lift arms. Upon activation of lift cylinders 71 the extension rods 73 will be extended thereby pivoting the lift arms about pivot point A.

As with the previous embodiment at least one linkage assembly 75 is provided having parallel links 76 and 77 which are mounted adjacent their upper ends to arms 78 and 79 extending outwardly from a knuckle assembly 80 which is rotatably secured about the pivot axis A. Each of the arms 78 and 79 have openings adjacent their outer ends to which the upper end portions of the links 76 and 77 are secured so that the pivot points D and E are equally spaced from the axis A. Further, the lower ends of the links 76 and 77 are pivotably secured to a bracket 82 which extends from the rear of the bucket B. The bracket 82 includes a pair of spaced openings 83 and 84 to which pivot pins are inserted to mount the lower ends of the links 76 and 77 thereto. The openings 83 and 84 are equally spaced in the same angular relationship with respect to the pivot axis B as are pivot points E and D associated with knuckle assembly 80. Again, as the lift cylinders are activated the lift arms which are also attached to the brackets at point B will raise the bucket B as shown in progression in FIGS. 4B and 4C. The angular orientation of the brackets 82 to the arms of the knuckle assembly will remain constant as the lift arms are elevated. However, the relationship in spacing between the links 76 and 77 will vary as the bucket is elevated as shown in the drawing figures. In the position of the bucket shown in FIG. 4B the link 77 will be aligned to intersect both the pivot axis A and B and at this point will, therefore, provide no support for the bucket. At this point the bucket will be locked in its pitched position by the upper link 76. As the bucket raises to the position shown in 4C it will be noted that the links 76 and 77 become aligned with one another.

Figure 5:
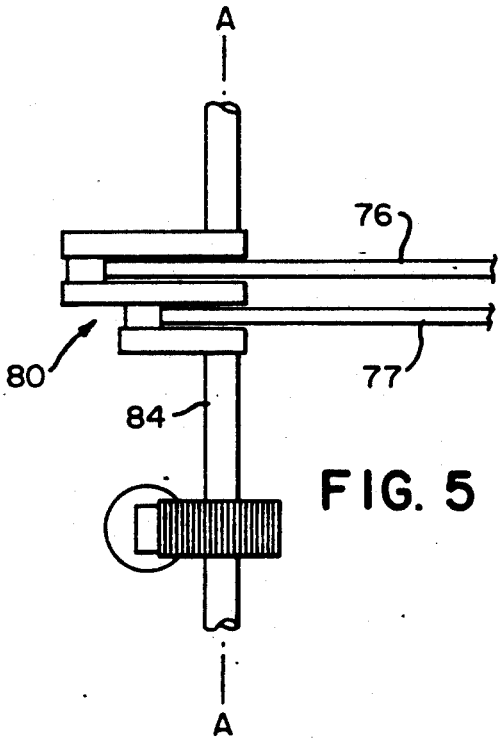
FIG. 5 is a partial top plan view of a variation of implement tilt linkage drive mechanism.

As with the first embodiment, the angle between the arms 78 and 79 may vary from the approximately 90° as shown in the drawing figures and may extend to almost 120° if desired. It is important however that the angular relationship defined by points E, A, D be identical to the angular relationship and spacing between points F, B and C. Although not shown in FIGS. 4A–4C the pitch of the bucket may be changed by applying a hydraulic piston to a third arm (not shown) which should be attached to the knuckle assembly in a manner similar to that described as the initial embodiment. As an alternative, and as shown in FIG. 5 the pivot shaft 84 may be an elongated drive shaft which is driven by the engagement of a gear drive mechanism 85 mounted to the shaft similarly as discussed with respect to the embodiment of FIGS. 2 and 3.

Figure 6A:
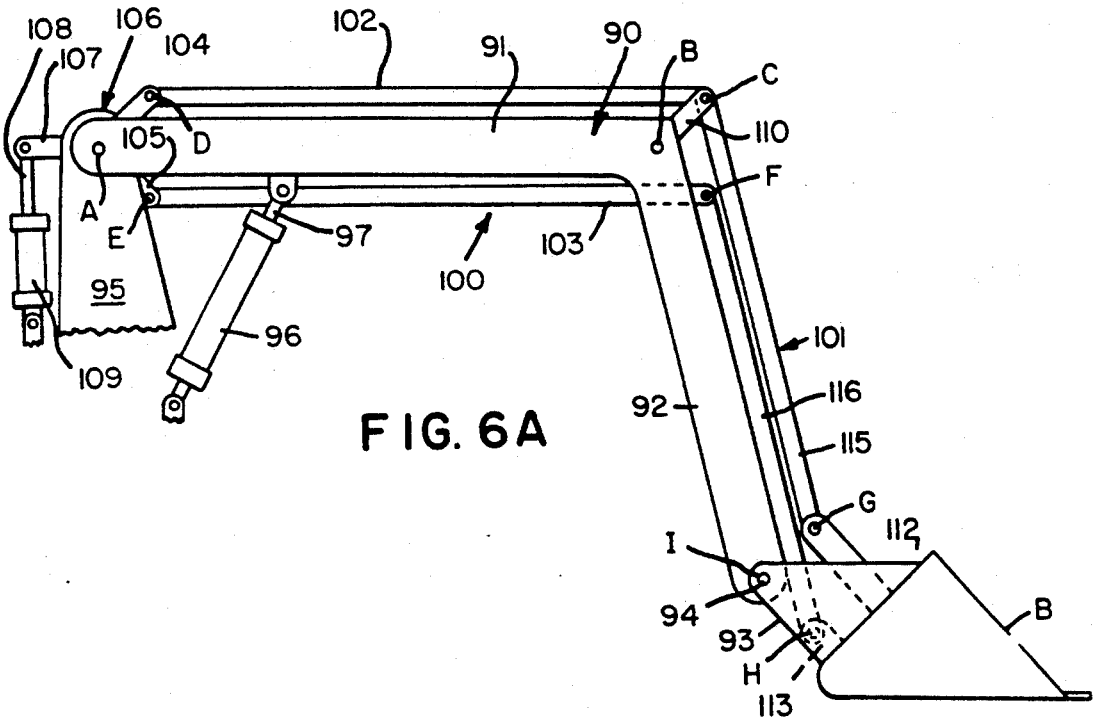
FIGS. 6A and 6B are side elevational views of yet another embodiment of the invention utilizing end-to-end linkage systems with the implement shown in a lowered raised position, respectively.
Figure 6B:
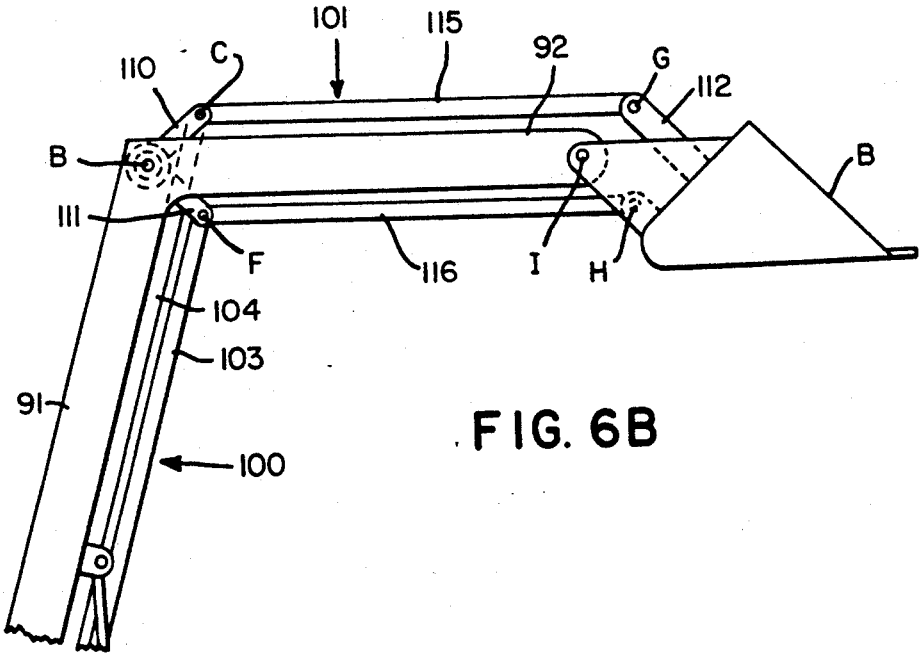

With continued reference to the drawings and in particular FIGS. 6A and 6B another embodiment of the present invention is disclosed in greater detail. As previously discussed, the imaginary double parallelogram link assembly developed by cooperation of the tilt linkage mechanism with and the pivot points of the lift arms of the vehicle may be extended so that two or more such double parallelogram systems are mounted in an end to end relationship. In this manner the displacement of the implement may be facilitated to reach into areas which otherwise would not be possible utilizing only one double parallelogram linkage system.

In this embodiment the bucket B is supported relative to the tractor T by way of a generally L-shaped pair of lift arms 90 having inner segments 91 and outer segments 92. The bucket includes a pair of spaced brackets 93 which extend from the rear surface thereof. The outer portion of the outer segment of the lift arm section 92 are pivotably connected at 94 to the mounting brackets 93. The pivot 94 forms the pivot axis of the bucket relative to the lift arm assembly is designated by the letter T. The innermost end of the inner segment 91 of the lift arm assembly 90 is mounted at a pivot axis A to flanges 95 mounted to the vehicle or tractor T. The lift arms are controlled by operation of lift cylinders 96 which are mounted to the vehicle and which include extension rods 97 which are connected to the inner or segments 91 of the lift arms.

The tilt linkage mechanism includes a first double parallelogram arrangement similar to the embodiment of FIGS. 1A–1C which is designated at 100 and an outer double parallelogram arrangement designated at 101. The first double parallelogram mechanism 100 includes a pair of links 102 and 103 which extend from a pair of spaced arms 104 and 105 which extend outwardly from a pivotable knuckle 106 mounted about a pivot shaft which is in axial alignment with the elongated pivot axis A of the implement lift arms. As in the embodiment of FIGS. 1A–1C the knuckle 106 includes a third arm 107 which is connected to the extension rod 108 of a tilt cylinder 109 which is utilized to control the pitch of the bucket by shifting the angular relationship of the knuckle 106 relative to the pivot axis A. The arms 104 and 105 include outer pivot points designated as D and E which are spaced equidistant from the pivot axis A as previously discussed. The far end of the links 102 and 103 which are disposed in parallel with respect to one another are connected to angularly spaced arms 110 and 111 carried by a pivotable knuckle mounted about a pivot axis B which is disposed on the lift arms at a point intermediate the pivot points A and I. The connection between the arms 110 and 111 and links 102 and 103 form pivot points C and F which are spaced equidistant with respect to pivot point B and are spaced from the pivot point B an amount equal to the spacing of the pivot points D and E from the pivot axis A. In this manner a double parallelogram arrangement is formed with one parallelogram being formed between pivot points A, B, C, and D and another between A, B, F and E.

In this embodiment the second double parallelogram arrangement 101 connects the pivot points C and F of the intermediate knuckle with a pair of mounting flanges 112 and 113 which are mounted to the rear of the bucket B. The double parallelogram linkage 101 includes a pair of elongated links 115 and 116 which extend between pivot points C and F and the flanges 112 and 113 respectively. As with the links 102 and 103 the links 115 and 116 are of equal length and are oriented parallel with respect to one another. The lower end of link 115 is pivotably mounted at point G which is spaced at the same angle of inclination and distance from pivot point I as the pivot point C is to pivot point B and the lower end of link 116 is connected at pivot point H which is spaced from pivot point I at the same distance and angle of inclination as pivot point F is to pivot point B. The second parallelogram is thereby defined from point B to point I to point G to point C and from point B to point I to point H to point F.

In the operation of the linkage mechanism of the present embodiment if the tilt cylinder 109 is not activated as the lift arms 91 are raised, the angle of inclination of the bucket will remain the same as is exemplified in drawing FIGS. 6A and 6B. It should be noted that as the lift arms are elevated that the double parallelogram 101 which is shown in FIG. 6A as being exposed on one side of the lift arm segment 92 will actually spread or open so that link 116 is disposed on an opposite side of the segment 92 from link 115 when in a raised position. In like manner, the links 102 and 103 of the first double parallelogram 100 will move from a position wherein the links are on opposite sides of lift arm segment 91 to a position where both links are on the lower side of the lift arm segment as shown in FIG. 6B.

It should be emphasized that although two double parallelogram linkages are disclosed in FIGS. 6A and 6B that additional linkages may be provided between the bucket and the tractor as is necessary so long as the multiple parallelogram arrangement set forth in the Figures is maintained.

I claim:

1. In a linkage assembly for self-levelling of an implement relative to a vehicle having at least one lift arm assembly having one end pivotably mounted to the vehicle about a first pivot axis and a second end pivotably mounted to the implement about a second pivot axis and wherein the first and second pivot axis are generally parallel with respect to one another, the improvement comprising, an implement tilt assembly including at least two generally parallel links having first and second ends, said implement tilt assembly further including first and second arm means having inner and outer end portions, means for mounting said inner end portions of said first and second arm means to the vehicle so as to be selectively rotatable about said first pivot axis, said outer end portions of said first and second arm means being disposed in angular relationship with respect to one another relative to said first pivot axis, a first pivot means for pivotably connecting said first end of one of said parallel links to said first arm means and a second pivot means for pivotably connecting said first end of the other of said parallel links to said outer end portion of said second arm means, a third pivot means for pivotably connecting said second end of said one of said parallel links to said implement and a fourth pivot means for pivotably connecting said second end of said other of said parallel links to said implement, said third and fourth pivot means being spaced from one another and from said second pivot axis, means for selectively rotating said first and second arm means about said first pivot axis, and said two parallel links and said first and second arm means defining overlapping parallelograms having a common side defined by a line extending between said first and second pivot axis.

2. The linkage assembly of claim 1 in which said two parallel links are offset with respect to one another in a vertical plane.

3. The linkage system of claim 2 wherein said outer end portions of said first and second arms are oriented at not greater than approximately 120° with respect to one another.

4. The linkage assembly of claim 3 in which said outer end portions of said first and second arms are oriented approximately 90° with respect to one another.

5. The linkage assembly of claim 1 in which said means for mounting said inner end portions of said first and second arm means about said first pivot axis includes a rotatable shaft aligned with said first pivot axis, said means for rotating said first and second arm means about said first pivot axis including a drive mechanism and means for engaging said drive mechanism to said shaft whereby said shaft may be continuously rotated through 360°.

6. The linkage assembly of claim 5 in which said drive mechanism includes a motor means, a gear means mounted on said shaft, and means for engaging said motor means with said gear means whereby upon activation of said motor means, said gear means is driven to drive said shaft to rotate said first and second arm means.

7. The linkage assembly of claim 5 in which the implement has side portions, said third pivot means and said fourth pivot means including bracket means extending outwardly with respect to the side portions of said implement, said lift arm assembly being pivotably mounted to a bracket by a shaft extending outwardly with respect to said side portions of said implement whereby upon activation of said drive mechanism said implement may be rotated continuously through 360°.

8. The linkage assembly of claim 1 in which said means for mounting said inner portions of said first and second arm means includes a knuckle assembly, said knuckle assembly having a third arm means extending outwardly with respect to said first pivot axis in angular relationship to said first and second arm means, and said means for selectively rotating said first and second arm means about said first pivot axis including a tilt actuator means connected to said third arm means.

9. The linkage assembly of claim 8 in which said tilt actuator means includes a piston means having an extension rod, said piston means being mounted to said vehicle.

10. The linkage assembly of claim 1 in which said lift arm assembly includes a pair of spaced lift arms extended between said first and second pivot axis, said parallel links being mounted between said first and second lift arms.

11. The linkage assembly of claim 1 in which said generally parallel links are mounted on opposite sides of the lift arm assembly.

12. The linkage assembly of claim 1 in which said at least two generally parallel links include at least first and second segments having first and second ends, said lift arm assembly including at least first and second segments which are angularly oriented with respect to one another, third and fourth arm means pivotably secured intermediate said first and second segments of said lift arm assembly about a third pivot axis, said third pivot axis being parallel with said first and second pivot axis, said third and fourth arm means being angularly oriented equal to the angular orientation of said first and second arm means, said third and fourth arm means having outer end portions, a fifth pivot means connecting said first and second segments of said one of said parallel links to said outer end portion of said third arm means and a sixth pivot means for connecting said first and second segments of said other of said parallel links to the outer end portion of said fourth arm means, whereby said first and second segments of said parallel links define two sets of double parallelograms having in common along a first of said double parallelograms a line extending from the first pivot axis to the third pivot axis and a line in common along the second set of parallelograms from said third pivot axis to said second pivot axis.

13. The linkage assembly of claim 12 in which said third and fourth arm means are pivotably associated with respect to said third pivot axis at the same angle as the first and second arm means are with respect to said first pivot axis.

14. The linkage assembly of claim 1 including at least one lift cylinder means mounted to the vehicle for raising and lowering said lift arm assembly with respect to said vehicle, said lift cylinder means including extension rod means and means for connecting said extension rod means to said lift arm assembly adjacent said vehicle.

15. The linkage assembly of claim 14 in which said means for selectively rotating said first and second arm means relative to said first pivot axis includes a tilt cylinder means mounted to said vehicle whereby said tilt cylinder means and said lift cylinder means are mounted to the vehicle and remote from the implement.

16. The linkage assembly of claim 1 in which said first and second pivot means are equally spaced from said first pivot axis and said third and fourth pivot means are equally spaced from said second pivot axis.

17. In a linkage assembly for self-levelling of an implement relative to a vehicle having a lift arm assembly having one end pivotably mounted to the vehicle about a first pivot axis and a second end pivotably mounted to the implement about a second pivot axis and wherein the first and second pivot axis are generally parallel with respect to one another, the improvement comprising, an implement tilt assembly including two generally parallel link means having first and second ends, said implement tilt assembly further including first and second arm means mounted to the vehicle and having inner and outer end portions, means for mounting said inner end portions of said first and second arm means so as to be selectively rotatable about said first pivot axis, said outer end portions of said first and second arm means being disposed in angular relationship with respect to one another relative to said first pivot axis, a first pivot means for pivotably connecting said first end of one of said parallel link means to said first arm means and a second pivot means for pivotably connecting said first end of the other of said parallel link means to said outer end portion of said second arm means, a third pivot means for pivotably connecting said second end of said one of said parallel link means to said implement and a fourth pivot means for pivotably connecting said second end of said other of said parallel link means to said implement, said third and fourth pivot means being spaced from one another and said second pivot axis, and means for selectively rotating said first and second arm means relative to said first pivot axis.

18. The linkage assembly of claim 17 in which said first and second pivot means are equally spaced from said first pivot axis and said third and fourth pivot means are equally spaced from said second pivot axis.

19. The linkage system of claim 18 wherein said outer end portions of said first and second arm means are oriented at not greater than approximately 120° with respect to one another.

20. The linkage assembly of claim 18 in which said first and second pivot means are spaced the same distance from said first pivot axis as said third and fourth pivot means are from said second pivot axis.

* * * * *